US006269801B1

(12) United States Patent
Channing

(10) Patent No.: US 6,269,801 B1
(45) Date of Patent: Aug. 7, 2001

(54) SYSTEM FOR PRIMING A DIESEL FUEL SYSTEM

(75) Inventor: Derek Albert Channing, Livonia, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/430,761

(22) Filed: Oct. 29, 1999

(51) Int. Cl.[7] ..... F02M 37/00
(52) U.S. Cl. ..... 123/516; 123/179.17
(58) Field of Search ..... 123/516, 446, 123/497, 179.9, 179.12, 179.17

(56) References Cited

U.S. PATENT DOCUMENTS

| | | | | |
|---|---|---|---|---|
| 3,982,519 | | 9/1976 | Moon . | |
| 4,079,717 | * | 3/1978 | Shirose | 123/136 |
| 4,177,788 | | 12/1979 | Morita et al. . | |
| 4,516,550 | | 5/1985 | Buck et al. . | |
| 4,602,599 | * | 7/1986 | Glagola | 123/187.5 R |
| 4,732,131 | * | 3/1988 | Hensel | 123/516 |
| 4,984,554 | * | 1/1991 | Ariga et al. | 123/516 |
| 5,307,770 | * | 5/1994 | Davis et al. | 123/179.11 |
| 5,351,666 | | 10/1994 | Bronkal et al. . | |
| 5,408,975 | * | 4/1995 | Blakeslee et al. | 123/491 |
| 5,839,413 | | 11/1998 | Krause et al. . | |
| 5,899,193 | | 5/1999 | Betz, II et al. . | |
| 5,927,253 | * | 7/1999 | Oyafuso et al. | 123/516 |

* cited by examiner

*Primary Examiner*—Andrew M. Dolinar
*Assistant Examiner*—Arnold Castro
(74) *Attorney, Agent, or Firm*—Jennifer Stec

(57) ABSTRACT

An apparatus for priming a diesel fuel system includes a diesel engine having a plurality of injectors. The injectors receive a supply of diesel fuel from a fuel injection pump. A fuel feed pump supplies diesel fuel to the fuel injection pump. A controller energizes said fuel feed pump during an initial operating time period. The controller then de-energizes said fuel pump during a second operating time period to prevent heat build up, noise, and battery drain. The controller then energizes said fuel feed pump during a priming time period, allowing the diesel fuel system to be primed with diesel fuel. The controller then de-energizes said fuel pump after said priming time period to prevent heat build up, noise, and battery drain.

20 Claims, 1 Drawing Sheet

SYSTEM FOR PRIMING A DIESEL FUEL SYSTEM

TECHNICAL FIELD

The present invention relates generally to diesel engines and, more particularly, to a system for priming a diesel fuel system.

BACKGROUND ART

Modern diesel fuel systems use an electronically controlled distributor injection pump. These injection pumps need a supplemental high capacity feed pump to deliver fuel to the vehicle fuel system. A typical cost effective feed pump to supply the amount of fuel required is an electrically driven roller vane or similar pump. Electrical energy to this pump is usually provided through a Powertrain Control Module (PCM) or Engine Electronic Controller (EEC).

Providing power through the electronic controller permits several advantages. These advantages include emergency shut down of the fuel pump in the event of an accident, using an inertia switch, to prevent fuel spills. Additionally, the fuel pump can be de-energized, if the key is in the on position, without the engine running. This prevents fuel pump overheating, due to absence of fuel flow. This also prevents excessive noise from the fuel pump, battery drain, and allows maximum electrical energy for starting aids, such as glowplugs. Of course, the pump runs continuously while the engine in running under normal operating conditions.

Unfortunately, if the electric pump is stationary, it usually (roller vane type) will not permit fuel to pass. This renders any manual attempt at priming the vehicle fuel system (removing any air in the fuel system) very difficult. The typical production method of removing air is using a dedicated downstream port, to apply a vacuum.

The typical service method (used after a fuel filter change, or accidentally running out of fuel), is to open a downstream port (usually provided at the Fuel Injection Pump or Main Fuel Filter), then run the electric pump, without running the engine, to purge the air from the system.

Because the fuel pump is NOT designed to run continuously with key on, engine off. Additional hardware has been proposed to allow priming of a diesel fuel system. The additional hardware includes dedicated software in a service tool, to be plugged into a diagnostic connector, an additional feed pump jumper wiring harness, or wiring communicating with the engine bay service light, that would permit the pump to run continuously, with the hood (bonnet) open and the key on.

Each of the above scenarios increases cost and reduces reliability of the overall vehicle. Thus, there exists a need to improve diesel fuel system priming.

SUMMARY OF THE INVENTION

It is an object of the invention to provide an improved and reliable means for priming a diesel fuel system. Another object of the invention is to allow diesel fuel system priming without the need for additional hardware.

In one aspect of the invention, an apparatus for priming a diesel fuel system includes a diesel engine having a plurality of injectors. The injectors receive a supply of diesel fuel from a fuel injection pump. A fuel feed pump supplies diesel fuel to the fuel injection pump. A controller energizes the fuel feed pump during an initial operating time period. The controller then de-energizes the fuel pump during a second operating time period to prevent heat build up, noise, and battery drain. The controller then energizes the fuel feed pump during a priming time period, allowing the diesel fuel system to be primed with diesel fuel. The controller then de-energizes the fuel pump after the priming time period to prevent heat build up, noise, and battery drain.

The present invention achieves an improved and reliable means for priming a diesel fuel system. Also, the present invention is advantageous in that it accomplishes this goal without the need for additional hardware.

Additional advantages and features of the present invention will become apparent from the description that follows, and may be realized by means of the instrumentalities and combinations particularly pointed out in the appended claims, taken in conjunction with the accompanying drawings.

BRIEF DESCRIPTION OF THE DRAWINGS

In order that the invention may be well understood, there will now be described some embodiments thereof, given by way of example, reference being made to the accompanying drawings, in which.

BEST MODE(S) FOR CARRYING OUT THE INVENTION

Figure 1:
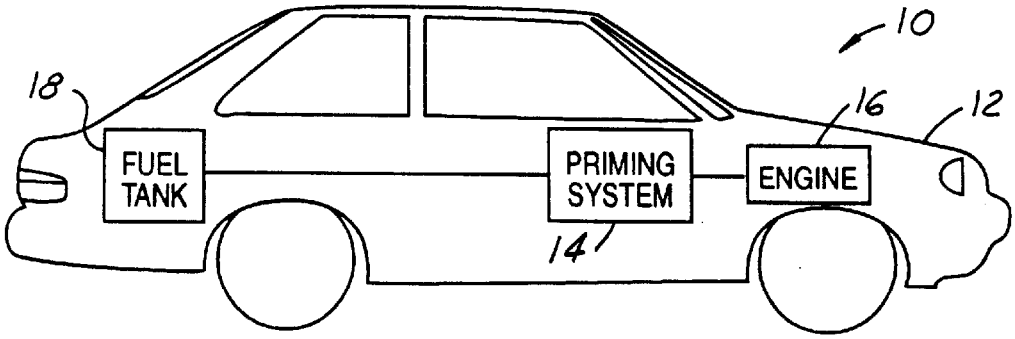
FIG. 1 is a block diagram of a system for priming a diesel fuel system according to one embodiment of the invention.

Referring to FIG. 1, a system for priming a diesel fuel system 10 according to one embodiment of the invention is illustrated. The system for priming a diesel fuel system 10 includes a vehicle 12, an apparatus for priming a diesel fuel system 14, a diesel engine 16, and a fuel tank 18.

Figure 2:
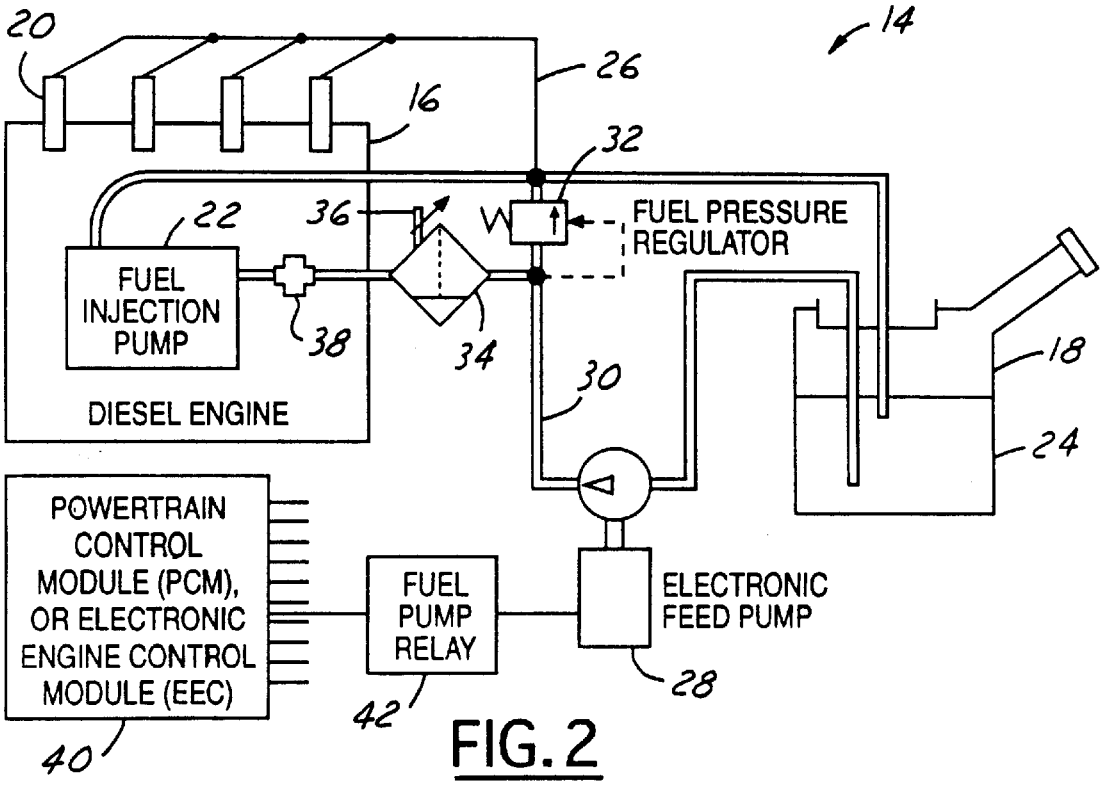
FIG. 2 is a block diagram of an apparatus for priming a diesel fuel system according to one embodiment of the invention.

Referring now to FIG. 2, a block diagram of an apparatus for priming a diesel fuel system 14 according to one embodiment of the invention is illustrated. Diesel engine 16 is located in vehicle 10 and has a plurality of injectors 20 for supplying diesel fuel 24 to one or more cylinders. Injectors 20 are coupled to a fuel injection pump 22, which supplies the injectors with diesel fuel 24 under high pressure through a return fuel line 26. The injectors 20 and fuel injection pump 22 are also coupled to the return fuel line 26 to allow excess diesel fuel 24 to return to fuel tank 18.

A fuel feed pump 28 supplies diesel fuel 24 at a lower pressure from fuel tank 18 to fuel injection pump 22 through a fuel line 30. In the present invention the pressure supplied by fuel feed pump 28 is regulated by a fuel pressure regulator 32. Fuel pressure regulator 32 is coupled to return fuel line 26 to allow excess diesel fuel 24 to return to fuel tank 18. A fuel filter 34 is coupled between fuel feed pump 28 and fuel injection pump 22 to filter undesirable matter from diesel fuel 24. In one embodiment of the present invention a manual air bleed valve 36 may be incorporated into fuel filter 34 to assist in priming the diesel fuel system after fuel filter 34 is changed. The present invention also includes a production purge valve 38 to assist in priming the diesel fuel system by permitting production vacuum air purging. Production purge valve 38 is preferably located in close proximity to fuel injection pump 22.

A controller 40 is coupled to, and, supplies power for fuel feed pump 28. Controller 40 may supply power to fuel feed pump 28 directly or through a fuel pump relay 42. When a vehicle key is turned to an "on" position, controller 40 energizes fuel feed pump 28 for an initial operating time period, which is determined by calibrating the initial operating time period to achieve a desired pressure. In the present invention, the initial operating time period lasts approximately 0.5 seconds. After the initial time operating period, controller 40 de-energizes fuel feed pump 28 for a second operating time period, which is determined by calibrating the second operating time period to minimize heat, noise, and power drain. In the present invention, the second operating time period lasts approximately 15.5 seconds. After the second operating time period, controller 40 energizes fuel feed pump 28 for a priming time period, which is determined by calibrating the priming time period to achieve full diesel fuel system priming. In the present invention, the priming time period lasts approximately thirty-two seconds. After the priming time period, controller 40 de-energizes fuel feed pump 28. In one embodiment of the present invention, an inertia fuel switch may be coupled between controller 40 and fuel feed pump 28 or directly to controller 40 to de-energize fuel feed pump 28 during a collision event. Of course, the fuel feed pump runs continuously while the engine is running under normal operating conditions.

In operation, this invention provides adequate time for the production line worker to complete several tasks. The worker can set up the vacuum priming equipment, or open the fuel vent. He can then enter the vehicle cab, turns the key on, and exit the vehicle cab. Finally, he can operate the priming equipment, or monitor the fuel/air vent, with the fuel pump running.

This invention also allows the operator or owner of the vehicle to remove air from the fuel system, after a fuel filter change, running out of fuel, or any other service reason to purge air from the fuel system. The operator or owner first enters the vehicle cab, turns the key on, and exits the vehicle cab. He then opens or monitors the fuel/air vent, with the fuel pump running. Finally, he closes the fuel vent, when all of the air is purged.

The method and system of the present invention provide improved and reliable means for priming a diesel fuel system. Also, the present invention is advantageous in that it accomplishes this goal without the need for additional hardware or service tools.

From the foregoing, it can be seen that there has been brought to the art a new and improved system for priming a diesel fuel system. It is to be understood that the preceding description of the preferred embodiment is merely illustrative of some of the many specific embodiments that represent applications of the principles of the present invention. Clearly, numerous and other arrangements would be evident to those skilled in the art without departing from the scope of the invention as defined by the following claims:

What is claimed is:

1. An apparatus for priming a diesel fuel system, said diesel fuel system comprising a diesel engine having a plurality of injectors, said injectors receiving a supply of diesel fuel from a fuel injection pump, said supply of diesel fuel stored in a fuel tank coupled to said fuel injection pump through a fuel line, said apparatus for priming comprising:

a fuel feed pump coupled in said fuel line between said fuel tank and said fuel injection pump, said fuel feed pump supplying said diesel fuel to said fuel injection pump; and a controller coupled to said electric fuel feed pump, said controller having control logic operative to calibrate a length of an initial operating time period such that said fuel feed pump obtains a desired pressure, energize said fuel feed pump during said initial operating time period, calibrate a length of a second operating time period such that heat is minimized, de-energize said fuel pump during said second operating time period, energize said fuel feed pump during a priming time period, whereby said diesel fuel system is primed with diesel fuel, and de-energize said fuel pump after said priming time period.

2. An apparatus for priming a diesel fuel system as recited in claim 1 further comprising a fuel filter coupled in said fuel line between said fuel feed pump and said fuel injection pump.

3. An apparatus for priming a diesel fuel system as recited in claim 2 wherein said fuel filter includes a manual air bleed valve.

4. An apparatus for priming a diesel fuel system as recited in claim 1 further comprising a production purge valve coupled in said fuel line between said fuel feed pump and said fuel injection pump in close proximity to said fuel injection pump.

5. An apparatus for priming a diesel fuel system as recited in claim 1 further comprising a fuel pressure regulator coupled in said fuel line between said fuel feed pump and a return fuel line.

6. An apparatus for priming a diesel fuel system as recited in claim 1 further comprising a fuel pump relay controlled by said controller, said fuel pump relay coupled to and controlling said electronic fuel feed pump.

7. An apparatus for priming a diesel fuel system as recited in claim 1 further comprising an inertia fuel switch coupled between said controller and said fuel feed pump whereby said fuel feed pump is de-energized during a collision event.

8. An apparatus for priming a diesel fuel system as recited in claim 1 further comprising an inertia fuel switch coupled to said controller whereby said fuel feed pump is de-energized by said controller during a collision event.

9. An apparatus for priming a diesel fuel system as recited in claim 1 wherein said controller includes control logic operative to energize said fuel feed pump for approximately 0.5 seconds during an initial operating time period, de-energize said fuel pump for approximately 15.5 seconds during a second operating time period, energize said fuel feed pump for approximately thirty-two seconds during a priming time period, whereby said diesel fuel system is primed with diesel fuel, and de-energize said fuel pump after said priming time period.

10. A system for priming a diesel fuel system, comprising:

a vehicle;

a fuel tank located in said vehicle;

a diesel engine located in said vehicle, said diesel engine having a plurality of injectors, said injectors receiving a supply of diesel fuel from a fuel injection pump, said supply of diesel fuel stored in said fuel tank coupled to said fuel injection pump through a fuel line;

a fuel feed pump coupled in said fuel line between said fuel tank and said fuel injection pump, said fuel feed pump supplying said diesel fuel to said fuel injection pump; and a controller coupled to said electric fuel feed pump, said controller having control logic operative to calibrate a length of an initial operating time period such that said fuel feed pump obtains a desired pressure, energize said fuel feed pump during said initial operating time period, calibrate a length of a second operating time period such that heat is minimized, de-energize said fuel pump during said second operating time period, energize said fuel feed pump during a priming time period, whereby said diesel fuel system is primed with diesel fuel, and de-energize said fuel pump after said priming time period.

11. A system for priming a diesel fuel system as recited in claim 10 further comprising a fuel filter coupled in said fuel line between said fuel feed pump and said fuel injection pump.

12. A system for priming a diesel fuel system as recited in claim 11 wherein said fuel filter includes a manual air bleed valve.

13. A system for priming a diesel fuel system as recited in claim 10 further comprising a production purge valve coupled in said fuel line between said fuel feed pump and said fuel injection pump in close proximity to said fuel injection pump.

14. A system for priming a diesel fuel system as recited in claim 10 further comprising a fuel pressure regulator coupled in said fuel line between said fuel feed pump and a return fuel line.

15. A system for priming a diesel fuel system as recited in claim 10 further comprising a fuel pump relay controlled by said controller, said fuel pump relay coupled to and controlling said electronic fuel feed pump.

16. A system for priming a diesel fuel system as recited in claim 10 further comprising an inertia fuel switch coupled between said controller and said fuel feed pump whereby said fuel feed pump is de-energized during a collision event.

17. A system for priming a diesel fuel system as recited in claim 10 further comprising an inertia fuel switch coupled to said controller whereby said fuel feed pump is de-energized by said controller during a collision event.

18. A system for priming a diesel fuel system as recited in claim 10 wherein said controller includes control logic operative to energize said fuel feed pump for approximately 0.5 seconds during an initial operating time period, de-energize said fuel pump for approximately 15.5 seconds during a second operating time period, energize said fuel feed pump for approximately thirty-two seconds during a priming time period, whereby said diesel fuel system is primed with diesel fuel, and de-energize said fuel pump after said priming time period.

19. A method for priming a diesel fuel system, comprising the steps of:

calibrating length of an initial operating time period such that a fuel feed pump obtains a desired pressure;

energizing said fuel feed pump during said initial operating time period in response to a key-on event;

calibrating length of a second operating time period such that heat is minimized;

de-energizing said fuel feed pump during said second operating time period;

energizing said fuel feed pump during a priming time period, whereby said diesel fuel system is primed with diesel fuel; and de-energizing said fuel feed pump after said priming time period.

20. A method for priming a diesel fuel system as recited in claim 19, further comprising the steps of:

energizing an fuel feed pump for approximately 0.5 seconds during an initial operating time period in response to a key-on event;

de-energizing said fuel feed pump for approximately 15.5 seconds during a second operating time period;

energizing said fuel feed pump for approximately thirty-two seconds during a priming time period, whereby said diesel fuel system is primed with diesel fuel; and de-energizing said fuel feed pump after said priming time period.

* * * * *